US006251029B1

(12) United States Patent
Roberts

(10) Patent No.: US 6,251,029 B1
(45) Date of Patent: Jun. 26, 2001

(54) GOLF CLUB HEAD

(75) Inventor: Michael David Roberts, Windsor (AU)

(73) Assignee: Play Sports Company PTY LTD, Windsor (AU)

( * ) Notice: Subject to any disclaimer, the term of this patent is extended or adjusted under 35 U.S.C. 154(b) by 0 days.

(21) Appl. No.: 09/377,809

(22) Filed: Aug. 20, 1999

(51) Int. Cl.[7] ..... A63B 53/04
(52) U.S. Cl. ..... 473/328; 473/350
(58) Field of Search ..... 473/287, 290, 473/291, 324, 328, 350

(56) References Cited

U.S. PATENT DOCUMENTS

| | | | |
|---|---|---|---|
| 4,319,752 | * | 3/1982 | Thompson . |
| 4,523,758 | | 6/1985 | Guendlling, Jr. . |
| 5,042,806 | * | 8/1991 | Helmstetter . |
| 5,154,423 | * | 10/1992 | Antonious . |
| 5,377,983 | | 1/1995 | Fenton . |
| 5,482,280 | | 1/1996 | Yamawaki . |
| 5,603,668 | | 2/1997 | Antonious . |
| 5,800,281 | | 9/1998 | Gilbert . |
| 5,931,745 | * | 8/1999 | Adams . |
| 6,093,113 | * | 7/2000 | Mertens . |

FOREIGN PATENT DOCUMENTS

| | | | | |
|---|---|---|---|---|
| 160030 | * | 3/1921 | (GB) | 273/167 A |
| 739403 | * | 10/1955 | (GB) | 273/167 A |
| 2 253 356 | | 9/1992 | (GB) . | |
| 2 286 130 | | 8/1995 | (GB) . | |

* cited by examiner

*Primary Examiner*—Sebastiano Passaniti
(74) *Attorney, Agent, or Firm*—Burr & Brown

(57) ABSTRACT

A golf club head is described having a unique sole configuration in which there are three separately identifiable planar regions angularly inclined to each other defining a substantially V-shaped ridge formed at the interfaces of the planar surfaces with one another. The apex of the V-shaped ridge is formed into a peak. The sole configuration allows a greater margin of error or deviation in the swing of the golfer from the ideal swing plane, so that there is a greater chance of producing an effective golf shot using the club head of the present invention.

14 Claims, 3 Drawing Sheets

GOLF CLUB HEAD

FIELD OF THE INVENTION

The present invention relates generally to golf clubs, particularly to golf club heads, including the heads of both irons and woods. More particularly, the present invention relates to improvements in or modifications of the sole portion of the golf club head by providing a new sole configuration having benefits and advantages. Even more particularly, the sole configuration has three separately identifiable planar regions angularly inclined to each other, defining a substantially V-shaped ridge formed at the interfaces of the planar surfaces with one another. Even more particularly, the apex of the V-shaped ridge is formed into a peak on the sole of the club head near to the bottom edge of the striking face of the club head. The sole configuration of the present invention allows a greater margin of error or deviation in the swing of a golfer from the ideal swing plane, whilst still producing an effective golf shot, such that there is a greater chance of accurately striking the ball so that it follows closely to the desired flight path.

SUMMARY OF THE INVENTION

Although the present invention will be described with particular reference to one form of one golf club head having a novel sole configuration, it is to be noted that the present invention is not limited in scope to the described embodiment, but rather the scope of the present invention is more extensive to include other configurations of the sole of the club head, the use of these configurations in other equipment, and to other applications of the various configurations other than those specifically described.

One of the problems of playing golf is to correctly strike the golf ball as often as possible so that the ball follows the desired trajectory or flight path. All too often, the golf ball is not correctly struck and the ball does not follow the desired trajectory, resulting in a poor shot which adds to the frustration of playing the game, which should ideally be enjoyable. This is particularly so of beginners or players with little experience or occasional golfers. One of the reasons for making a poor shot is that the striking face of the club does not hit the ball square on in the "sweet spot" of the club head, but rather the striking face of the club is skewed sideways or tilted as a result of a poor swing or hitting the ground before the ball, so that the ball, if it travels at all, flies off in the wrong direction.

When playing a golf shot, typically a fairway iron shot, it is desirable that during the swing the club head strikes the ball first, preferably square on to the ball and with the sweet spot of the club head, then continues on and takes a divot from the ground at the beginning of the follow-through of the club head, and then continues on in the full follow-through of the swing, thus producing a good golf shot. If the swing is a good swing, say following the ideal swing plane, taking the divot does not interfere with the flight path or trajectory of the ball as the ball has been struck and has commenced its flight before the club head hits the ground or as the divot is taken, so that even if the club head is skewed it does not affect the flight of the ball. However, if the swing or golf shot is not a "textbook" shot but rather deviates from the correct swing plane, a divot can be taken either before or as the ball is struck, or the club can hit the ground before it hits the ball, which in either case results in the club head being deflected, sometimes considerably, by contact with the ground, from the ideal swing plane so that the club head face is not square on to the ball or the ball is not hit with the sweet spot of the club head when it is struck, if it is struck at all. As a result, the golf shot overall will be poor, such as for example by contact with the ground, causing the club head to twist or skew, thereby causing the ball to spin to the left or right in a hooking or slicing manner, or being mis-hit or even completely missing the ball if the club head is sufficiently deflected far enough from the ideal swing plane to miss the ball. The configuration of the sole of a golf club head plays an important role in producing a "good" golf shot, since the sole portion of the club, being closest to the ground, is that part of the club head which actually makes contact with the ground first when taking a divot or when inadvertently hitting the ground, such as for example when the swing results in the club head being slightly lower than the ideal swing plane. The conventional sole configuration of golf club heads contributes to mis-hitting the ball, due to the shape of the sole being either flat or in the shape of a shallow curve. The conventional sole configuration is a compound curve in that the lower surface of the club head is smooth and extends in one shallow curve which is almost flat from the heel of the club adjacent where the shaft of the club joins to the head to the toe of the club at the other end of the head, and extends in another substantially transverse shallow curve between the front hitting face of the club head to the rear wall. The shape of the curved sole configuration, being essentially elongatedly rounded, means that the sole of the head needs to be accurately aligned with the surface of the ground immediately behind the ball for the shot to be good, or otherwise the shot will be poor since there is little margin for error, because of the relatively long length of the sole that can contact the ground to deflect the club head from its swing path. If the sole of the club head is slightly misaligned due to a poor swing or the like, the sole will strike the ground before or simultaneously with the ball, thereby deflecting the club head, particularly deflecting the front hitting face of the head, from the ideal swing plane, thereby producing a bad shot in which the ball travels in the wrong direction since the ball would not be hit in the sweet spot.

When using a golf club having a head of the conventional shape, being a compound curve, a problem that arises when a golfer's swing is not along the ideal swing plane, but rather intersects the swing plane, causing the ball to be struck off-centre or not square on, is that the golfer often strikes the ground with either the toe or heel of the club before the ball is struck. In doing so, the club head is deflected off-line, causing a poor shot as the ball either hooks, slices or otherwise does not follow the desired flight path, or in extreme circumstances is a mis-hit in which the ball is not struck at all. This is because the bottom surface of the club head or sole extends almost the length of the head from the heel to the toe, as the sole is a shallow curve between the heel and toe, resulting in a significant amount of the length of the club head being close to the ground when the ball is struck, so that the opportunity for hitting the ground with part of the sole of the club is greater. Thus, if anywhere along almost all of the length of the sole configuration, such as from the heel portion to the toe portion, touches the ground before the ball, the club head will be deflected from the ideal swing path, resulting in a "poor" shot with the ball not following the intended trajectory.

Whilst the sole configuration of golf club heads is conventionally flat or smoothly curved in order to provide as flat a surface as possible with which to clear the ground when making a shot, variations of the sole configuration have been made in the past in attempts to improve this characteristic of the golf club head by providing non-planar sole configurations in order to take into account a golfer's swing deviations from the ideal swing plane. However, these variations have not been entirely successful for one reason or another. Some golf club heads are available with a variation of this conventional sole configuration. Other golf club heads have a more complex sole configuration primarily designed to combat one or more specific defects in a player's swing or to address one or more specific situations encountered on the golf course, such as for example for various specific functions relating to a particular club.

If the sole configuration of the club head could be changed to accommodate more deviation of a golfer's swing from the ideal swing plane without the club head touching the ground, such as for example without either the toe or heel of the club head touching the ground and producing a mis-hit of the ball, there would be a greater chance of performing a good shot and a larger margin of error in the golfer's swing could be tolerated, which would be to the advantage of the golfer, particularly the inexperienced or occasional player.

Thus, there is a need for modification to the head of a golf club, particularly to the sole configuration of the head, to give the golfer a better chance of hitting the ball correctly and reducing the adverse effects of departing from the ideal swing path by providing an improved sole configuration having greater clearance from the ground in the toe and heel regions of the club head.

Therefore, it is an aim of the present invention to provide a golf club head having an improved sole configuration that allows a golfer to hit a good golf shot more regularly by providing an increased margin for error in departing from the ideal golf swing by providing a sole configuration having angularly inclined planar surfaces allowing greater clearance between the ground at the heel and toe regions of the club head and/or allowing the club to be swung at greater deviations from the ideal swing path whilst still producing a good shot. This aim is satisfied by providing a sole configuration of separately identifiable planar surfaces angularly inclined to each other to form a V-shaped ridge in which the apex of the V-shape is a peak.

According to the present invention there is provided a golf club head having a sole configuration extending from the heel of the club head to the toe of the club head, said sole configuration including angularly inclined planar surfaces arranged with respect to each other to define a generally V-shaped ridge or peak along the interfaces between adjacent planar surfaces, thereby providing improved clearance between the toe and heel portions of the sole from the ground during a golf swing, wherein at least one of the planar surfaces is a first surface extending from the heel of the club head, at least another of the planar surfaces is a third surface extending from the toe of the club head, and another of the planar surfaces is a second planar surface located intermediate the first and third planar surfaces so that the second planar surface has an interface with the first planar surface and with the third planar surface.

Typically, the sole configuration of the present invention includes three planar surfaces angularly inclined to each other. More typically, the first surface extending from the heel of the club head is inclined at 10° to the horizontal or flat surface of the sole of the club head containing the apex of the V-shaped ridge in the lengthwise extending direction of the club head along the line from the centre of the sole towards the heel of the club. More typically, the inclination at 10° is in an inboard direction, i.e. towards the interior of the club head, in the direction from the centre of the head to the heel. Typically, the third planar surface extending from the toe of the club head is inclined at 10° to the horizontal or flat surface of the sole of the club head containing the apex at the V-shaped ridge in the lengthwise extending direction of the club head, i.e. along the line from the centre of the sole towards the toe of the club head. More typically, the inclination at 10° is in an inboard direction, i.e. towards the interior of the club head, in the direction from the centre of the head to the toe.

Typically, the second planar surface located intermediate the first and third planar surfaces is aligned along or forms the normal flat surface of the sole and is regarded as being horizontal, having zero degrees of inclination. Typically, the 0° inclination is in the lengthwise extending direction between heel and toe and in the transverse direction from front to back of the head.

More typically, the first planar surface is inclined at an angle of 12° from the horizontal flat section of the sole of the club head in the direction into the club head from the rear surface of the club head to the front surface. Thus, the club head is slightly lower at the front face of this first planar surface thereby providing increased ground clearance at the front hitting surface of the first surface, thereby slightly spacing the front hitting surface off the ground when the rear of the club in this region touches the ground, such as for example during a golf swing, thereby providing greater flexibility in the swing path. Thus, the first planar surface is angularly inclined in both the lengthwise extending direction and the transverse extending direction, preferably at different angles, and more preferably at 10° and 12° respectively.

More typically, the third planar surface is also inclined at an angle of 12° to the horizontal in the same direction as the inclination of the first planar surface. Thus, the third planar surface is angularly inclined along both the lengthwise extending direction and the transverse extending direction, preferably to different degrees and more preferably at 10° and 12° respectively.

More typically, the second planar surface located between the first and third planar surfaces is arranged to lie along the horizontal of the sole, such as at 0° inclination. Even more typically, the second planar surface is the reference level or datum level with respect to which the other planar surfaces are described or defined.

Even more typically, each of the three planar surfaces are substantially triangular. Typically, one side of the first triangular planar surface is located adjacent the heel of the club head.

Typically, one side of the third triangular planar surface is located adjacent the toe of the club head. More typically, the second triangular planar surface is located so that one side of the triangle is aligned along the bottom edge of the rear face of the club head.

Typically, one arm of the V-shaped ridge is formed along the interface of the first and second planar surfaces while the other arm of the V-shaped ridge is formed along the interface of the second and third planar surfaces.

Typically, the angle between the two arms of the V-shaped ridge is about 106°. More typically, the apex of the V-shape is in the form of a peak or similar forming the lowermost point of the sole of the club head in use of the golf club.

BRIEF DESCRIPTION OF THE DRAWING FIGURES

The present invention will now be described by way of a non-limiting example with reference to the accompanying drawings in which.

DETAILED DESCRIPTION OF THE INVENTION

Figure 1:
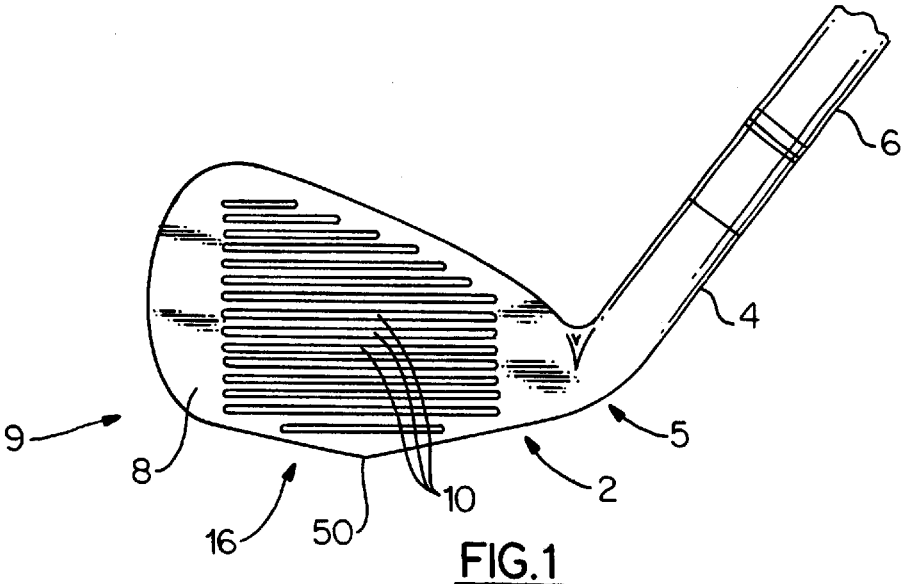
FIG. 1 is a front view of the golf club head of the present invention showing the front striking surface.
Figure 2:
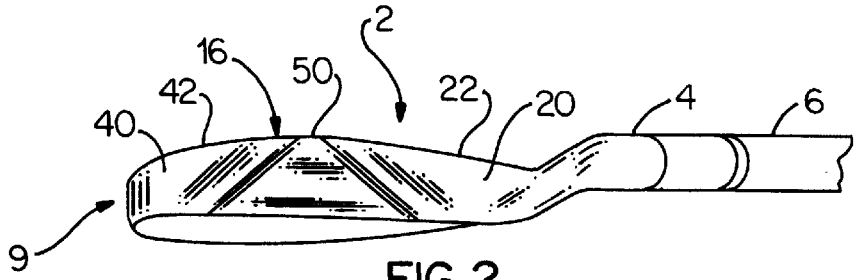
FIG. 2 is an underneath plan view of the golf club head of FIG. 1 showing the sole configuration.
Figure 3:
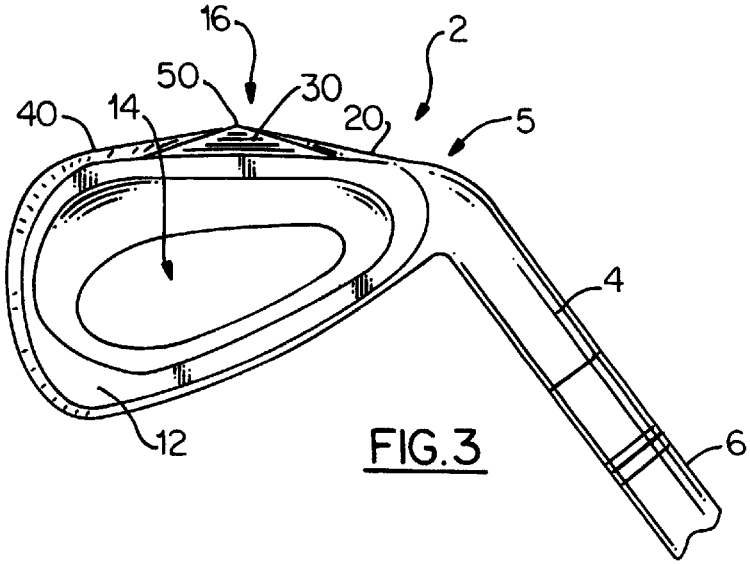
FIG. 3 is a rear view of the golf club head of FIG. 1 showing the scooped rear wall and part of the sole configuration.

In FIGS. 1 to 3 there is shown one form of the golf club head of the present invention, generally denoted as 2. Club head 2 is provided with a hollow socket 4 or ferrule located at or towards the heel 5 of club head 2 for receiving shaft 6 therein so that shaft 6 terminates with head 2. The angle of inclination of shaft 6 to head 2 is in accordance with conventional practice and changes in accordance with the particular club. Head 2 has a front striking face 8 provided with a plurality of generally spaced apart grooves 10 in parallel relationship for assisting in imparting spin to the golf ball (not shown) when struck, particularly backspin, and a rear wall 12 provided with a cut-out or scoop 14 contributing to the lowering of the centre of gravity of the head 2. It is to be noted that the angle of loft of the striking face is also in accordance with conventional practice and changes in accordance with the particular club. The lower surface or edge of head 2 extending between the front striking face 8 and rear wall 12 forms the sole 16 of the club head 2. Sole 16 has a unique configuration in accordance with the present invention as shown more particularly in FIG. 2.

The unique sole configuration of the present invention includes a first planar portion 20, a second planar portion 30 and a third planar portion 40 in which the second portion 30 is located intermediate the first 20 and third 40 portions. The first planar surface or portion 20 extends from the heel 5 of head 2 towards the centre of the sole 16. The first planar portion 20 is substantially triangular in shape in which the longest side 22 of the triangle is aligned along the bottom edge of the front striking face 8 and extends from the heel 5 of the head to about the midpoint of the lower edge of the front striking face 8.

The unique sole configuration of the present invention includes another planar surface or portion 30 which is located intermediate the other two portions 20, 40. The second or intermediate portion 30 is also a substantially triangular portion with the longest side 32 of the triangle aligned along the lower edge of the rear wall 12, with the apex of the triangle meeting at the midpoint of the front lower edge which is about the midpoint of the bottom edge of the striking face.

A third planar surface 40 is located towards the toe 9 of head 2 and is also substantially triangular in shape with the longest side 42 of the triangle being aligned along the lower edge of the front striking face between the toe of the club head and its midpoint.

All three substantially triangular planar portions 20, 30 and 40 are angularly inclined to each other with the first and third portions oppositely inclined to each other to form a peak 50 at the midpoint of the lower edge of the front striking face 8 and the second planar region 30 being inclined to both of the other planar surfaces 20, 40 and sloping away from peak 50 at the front of the sole towards the lower edge of the rear wall in the region of the longest side 32.

Owing to the inclination of the three planar surfaces 20, 30, 40, a generally V-shaped ridge is formed by the respective junction lines or interfaces between the first and second surfaces on the one hand and the second and third surfaces on the other hand. It is to be noted that peak 50 is formed at the point where all three triangular planar portions 20, 30, 40 meet each other. Thus, in the normal, in use position of the club, the peak 50 is the lowermost extremity of the sole 16 of head 2 as all of planar surfaces 20, 30, 40 slop inboardly from this point, i.e. in a direction into the interior of the club head. Further, scoop 14 of the rear wall 12 permits more material from which the club head is made, typically metal, to be located along the sole of the head. This, combined with peak 50 at the sole, lowers the centre of gravity of the club head towards the sole of the head.

Figure 7:
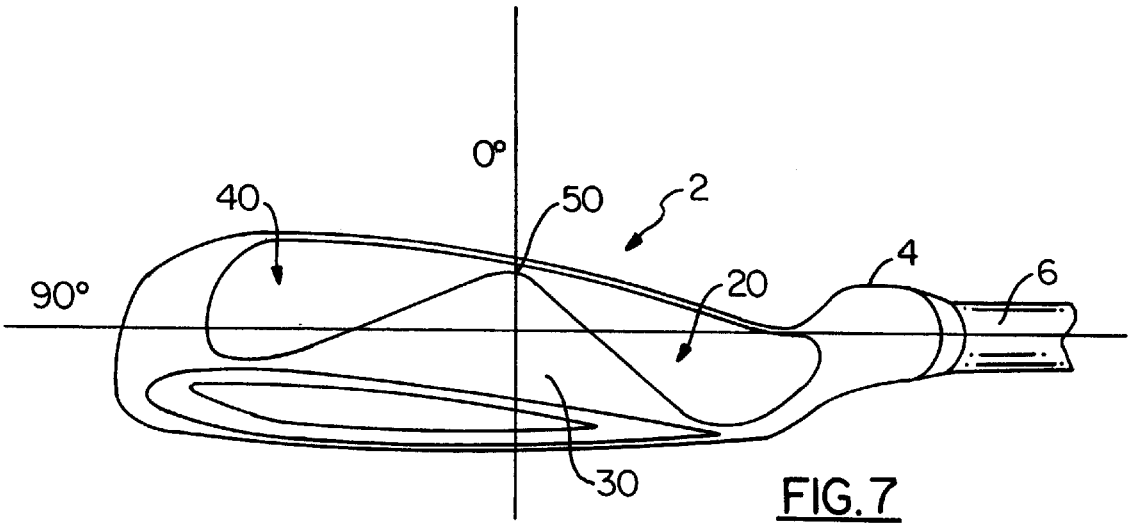
FIG. 7 is an underneath view of the club head similar to FIG. 2 showing the datum levels forming a reference for measurement of the inclined planar surfaces.
Figure 8:
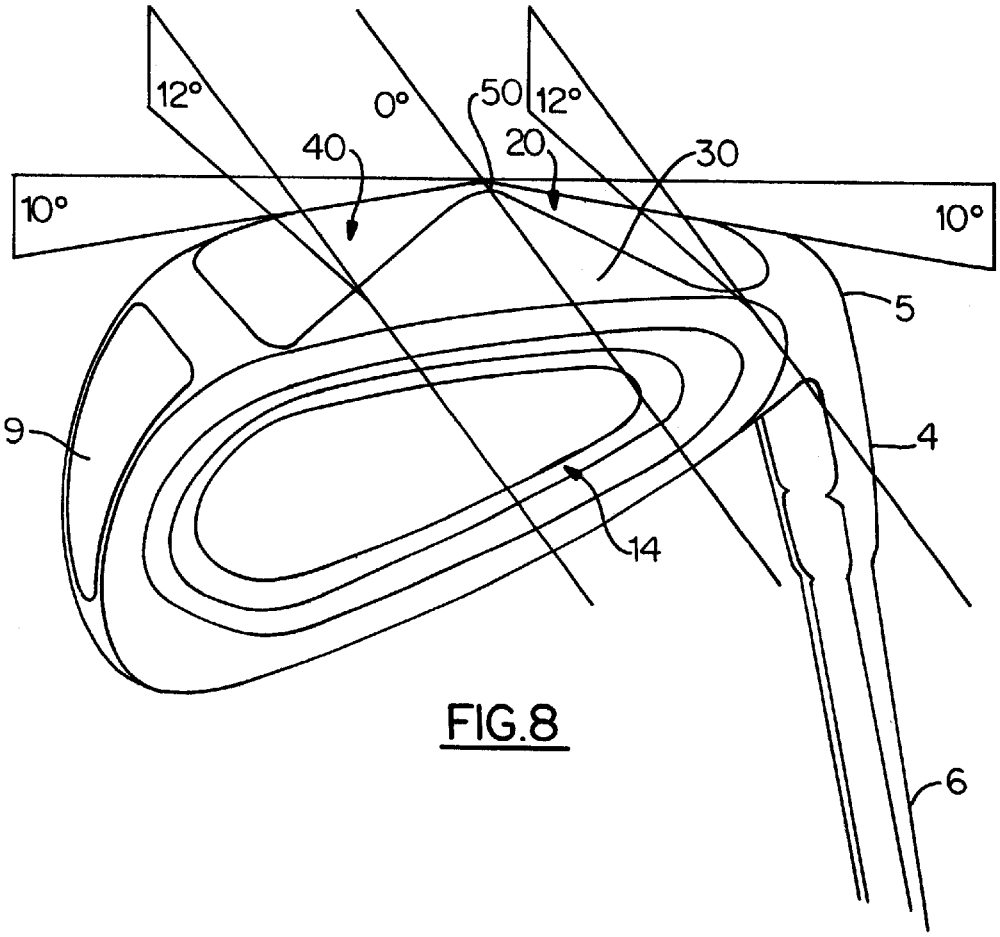
FIG. 8 is an underneath rear perspective view of the golf club head showing the angles of inclination of the individual planar surfaces relative to the datum levels of a preferred form of the golf club head of the present invention.

With particular reference to FIGS. 7 and 8, the relative spatial arrangement of the respective surfaces for a preferred embodiment of the club head of the present invention can be seen. The angle of inclination in the lengthwise extending direction of the first and third planar surfaces 20, 40 with respect to the central surface taken as the horizontal or 0° or used as a datum level can be between about 5° and 20°, preferably between about 7° and 15°, and more preferably between about 8° and 12°, with the most preferred value being 10°.

The angle of inclination in the transverse direction of the first and third planar surfaces can be between about 5° and 20°, preferably between about 7° and 15°, more preferably between about 9° and 14°, with the most preferred value being about 12°.

The angles of inclination of the first and third planar surfaces 20, 40 are measured with reference to the second planar surface 30 having 0° of inclination in both the lengthwise extending direction and the transverse extending direction.

Operation of the club head of the present invention will now be described with reference to FIGS. 4 to 6.

Figure 4:
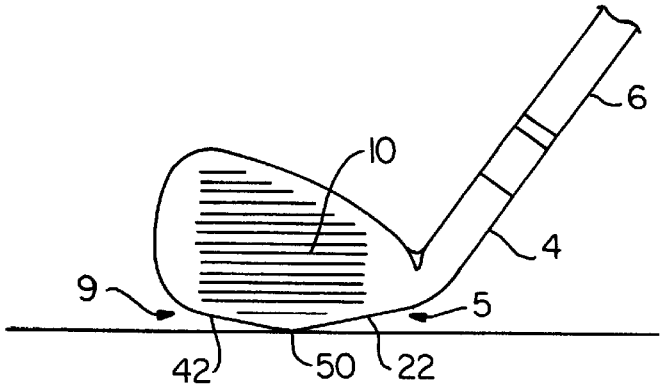
FIG. 4 is a front view of the club head of FIG. 1 during a golf swing on a level lie.

With particular reference to FIG. 4, the orientation of the club head 2 with respect to the ground surface when there is a normal lie of the ball on ground level and/or when the golf swing is along the ideal swing plane is shown. In this orientation, the striking face of the club head 8 approaches the ball square on as the swing is along the ideal swing plane and the V-shaped ridge or peak is almost touching the ground surface as the ball is struck. As the club head is following the ideal swing path, the ball is struck correctly and follows the desired flight path or trajectory.

Figure 5:
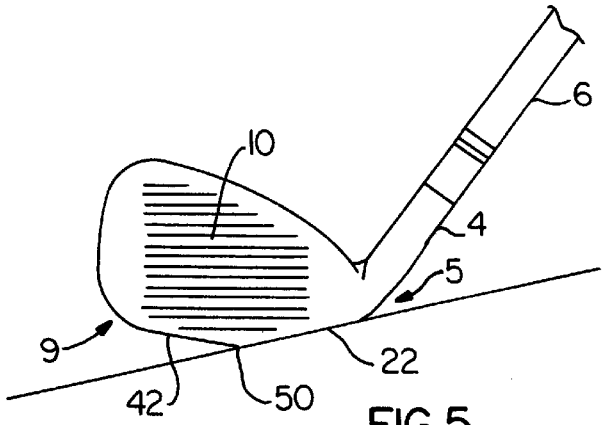
FIG. 5 is a front view of the club head of FIG. 1 during a golf swing on a downhill hillside lie when hitting across the slope.

With particular reference to FIG. 5 which shows the orientation of the club head 2 with respect to the ground where the golfer is facing downhill when making the stroke across the slope, or in the circumstance where the actual swing of the club head follows an arc which is further away from the golfer then when the club head follows the ideal swing path, irrespective of whether the golfer is on the flat or on a slope, known as a flat plane swing, it can be seen that the orientation of the club head with respect to the ground is tilted towards the shaft of the club when compared to the normal orientation as shown in FIG. 4. The tilting of the ground when facing downhill, or of the club when the arc is too far away during the flat plane swing, results in the sole of the club head near to the heel being closer to or oriented towards the ground so that in a conventional club head the sole in the region of the heel of the club would strike the ground before hitting the ball. However, with the club head of the present invention having the first planar surface 20 there is a clearance between the sole in the region of the heel and the ground which allows the club to follow the swing and not to hit the ground before the ball because it is angled away from the ground. In this orientation, the striking face can hit the ball before the club head hits the ground, thereby producing an effective golf shot.

Figure 6:
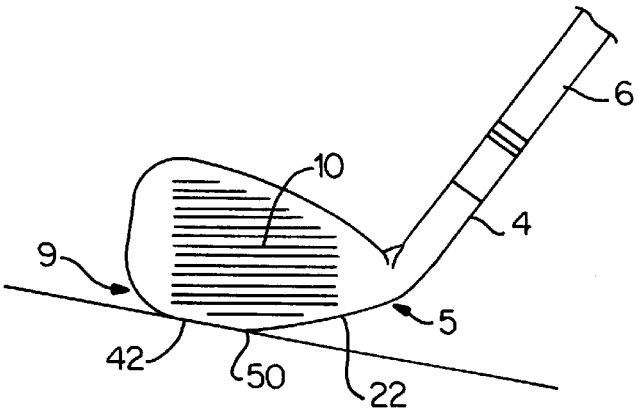
FIG. 6 is a front view of the club head of FIG. 1 during a golf swing on an uphill hillside lie when hitting across the slope.

With particular reference to FIG. 6 there is shown the orientation of the club head 2 with respect to the ground when there is an uphill slope facing the golfer when hitting the ball across the slope, or in the circumstance where the actual swing of the club head follows an arc which is closer to the golfer than that of the ideal swing path, irrespective of whether the golfer is on the flat or on a slope, known as the upright plane. The club head is tilted away from the shaft of the club so that with a conventional club head the toe portion of the head would strike the ground before the striking face of the head could strike the ball, thereby deflecting the club head from the ideal swing path and producing a poor shot. However, because of the angled third planar surface 40 being located near the toe of the club, there is increased clearance between the sole and the ground so that the club head does not touch the ground before the ball is struck, thereby considerably reducing the chance of a poor golf shot.

Advantages of the club head of the present invention include the following:

The golf club head of the present invention having a unique sole configuration caters for the taller and for the shorter player without any special alterations to the lie of the club when addressing the ball or swinging the golf club due to the V-shaped sole configuration of the head. The V-shaped configuration allows the shorter player to address the ball with the angle of the shaft of the club being flatter or less inclined than with a player of normal height. Further, the taller player can address the ball at a steeper angle than normal. Owing to the V-shape sole configuration, the club head clears the ground even if the angle of the shaft is misaligned from the normal angle or from the normal plane of swing due to inclined planar surfaces 20, 40 on either side of club head 2.

The centre of gravity of the club head is lowered due to the increased amount of material and weight present in the peak of the V-shaped ridge of the sole configuration as more weight is centred at the bottom of the head. This is particularly achieved when the back or rear wall of the club is scooped.

The centre of gravity of the club head is lowered slightly due to the formation of the peak where all three planar surfaces meet on the sole of the club head, so that there is a greater margin for error in hitting the ball with the club head and still achieving the desired golf shot due to the increase in mass or weight of material located in the peak at the extreme base of the sole of the head.

The V-shaped sole configuration acts as a "turf cutter", particularly when present on the iron club heads, which offers less resistance to the ground when a divot is taken by taking less of a divot.

The V-shaped sole configuration assists in cutting the grass located immediately adjacent the ball and in fact cuts the grass after striking the ball, such as for example before or when taking a divot, therefore allowing the sweet spot of the club head to correctly contact the ball. This configuration presents a clean, sharp cutting edge, reducing or eliminating deflection of the club head, thereby reducing the chances of a mis-hit by the club head being deflected when striking the ball.

The lower centre of gravity causes the ball to roll further up the striking face when hit, thereby imparting better backspin on the ball which in turn allows the ball to follow the desired trajectory so that there is truer flight of the ball along the desired path.

If the club hits the ground first there is a reduced chance that the club head will be deflected by contact with the ground, because there is less of the sole to hit the ground as the peak is the lowermost part of the sole which has a very small width as compared to the length of the sole.

The described arrangement has been advanced by explanation and many modifications may be made without departing from the spirit and scope of the invention which includes every novel feature and novel combination of features herein disclosed.

Those skilled in the art will appreciate that the invention described herein is susceptible to variations and modifications other than those specifically described. It is understood that the invention includes all such variations and modifications which fall within the spirit and scope.

What is claimed is:

1. A golf club head having a sole configuration extending from the heel of the club head to the toe of the club head, said sole configuration including angularly inclined planar surfaces arranged with respect to each other to define a generally V-shaped ridge formed along the interfaces between adjacent planar surfaces on the sole of the club, when viewing the sole of the club, for providing increased clearance between the toe and the heel portions of the sole and the ground during a golf swing, wherein at least one of the planar surfaces is a first surface extending from the heel of the club head, at least another of the planar surfaces is a third surface extending from the toe of the club head, and another of the planar surfaces is a second planar surface located intermediate the first and third planar surfaces, so that the second planar surface has an interface with the first planar surface and with the third planar surface to form the generally V-shaped ridge along the interfaces and wherein the V-shaped ridge is provided with a peak located at a position corresponding to the junction of the first, second and third planar surfaces when viewing the sole of the club, said peak of the V-shaped ridge being formed at the apex of the V-shaped ridge.

2. A golf club head according to claim 1 in which the sole configuration includes three planar surfaces only angularly inclined to each other to form the V-shaped ridge having the peak.

3. A golf club head according to claim 1 in which the first and third planar surfaces are angularly inclined both in the lengthwise extending direction and in the transversely extending direction.

4. A golf club head according to claim 1 in which the angle of inclination of the first and third planar surfaces in the lengthwise extending direction is different to the angle of inclination in the transversely extending direction.

5. A golf club head according to claim 1 in which the peak of the V-shaped ridge formed at the apex of the V-shaped ridge is the lowest part of the golf club head in use of the golf club head.

6. A golf club head according to claim 5 in which the first and third planar surfaces are oppositely inclined to each other to provide clearance at the heel and at the toe respectively of the sole of the golf club head between the ground on either side of the peak during a swing of the golf club.

7. A golf club head according to claim 5 in which the first, second and third planar surfaces are all substantially triangular planar surfaces arranged around the peak.

8. A golf club head according to claim 7 in which the three substantially triangular planar surfaces all have a common apex which is the peak formed at the apex of the V-shaped ridge by the two interfaces of the three triangular planar surfaces intersecting each other.

9. A golf club head according to claim 8 in which the three triangular planar surfaces of the first, second and third planar surfaces are substantially different in shape.

10. A golf club head according to claim 1 in which the interface between the first and second planar surfaces forms one arm of the V-shaped ridge and the interface between the second and third planar surfaces forms the other arm of the V-shaped ridge.

11. A golf club head according to claim 1 in which the first planar surface extending from the heel of the club head and the third planar surface extending from the toe of the club head are inclined in the lengthwise extending direction at an angle between 5° and 20° to the angle of the second planar surface.

12. A golf club head according to claim 11 in which the first planar surface and the third planar surface are each inclined in the lengthwise extending direction at an angle of 10° to the angle of inclination of the second planar surface.

13. A golf club head according to claim 1 in which the first and third planar surfaces are each inclined in the transversely extending direction at an angle of between 5° and 20° to the angle of inclination of the second planar surface.

14. A golf club head according to claim 13 in which the first and third planar surfaces are each inclined in the transversely extending direction at an angle of 12° to the plane of inclination of the second angular planar surface.

* * * * *